US012630932B2

(12) United States Patent
Feaster et al.

(10) Patent No.: US 12,630,932 B2
(45) **Date of Patent: *May 19, 2026**

(54) DIRECT CONVERSION OF AIR TO AMMONIA AND NITRIC ACID VIA ADVANCED MANUFACTURED ELECTROCHEMICAL REACTORS

(71) Applicant: LAWRENCE LIVERMORE NATIONAL SECURITY, LLC, Livermore, CA (US)

(72) Inventors: Jeremy Taylor Feaster, Fremont, CA (US); Roger D. Aines, Livermore, CA (US); Sneha Anil Akhade, Oakland, CA (US); Sarah E. Baker, Dublin, CA (US); Patrick G. Campbell, Oakland, CA (US); Maira R. Cerón Hernández, Brentwood, CA (US); Jonathan Tesner Davis, Oakland, CA (US); Eric B. Duoss, Dublin, CA (US)

(73) Assignee: LAWRENCE LIVERMORE NATIONAL SECURITY, LLC, Livermore, CA (US)

( * ) Notice: Subject to any disclaimer, the term of this patent is extended or adjusted under 35 U.S.C. 154(b) by 773 days.

This patent is subject to a terminal disclaimer.

(21) Appl. No.: 18/052,310

(22) Filed: Nov. 3, 2022

(65) Prior Publication Data

US 2023/0151499 A1 May 18, 2023

Related U.S. Application Data

(60) Provisional application No. 63/263,520, filed on Nov. 4, 2021.

(51) Int. Cl.
*C25B 1/27* (2021.01)
*C25B 1/22* (2006.01)
(Continued)

(52) U.S. Cl.
CPC ..... *C25B 1/27* (2021.01); *C25B 1/22* (2013.01); *C25B 11/077* (2021.01); *C25B 11/081* (2021.01); *C25B 11/089* (2021.01)

(58) Field of Classification Search
CPC ..... C25D 1/00; C25D 1/22; C25D 1/27
See application file for complete search history.

(56) References Cited

U.S. PATENT DOCUMENTS 9,540,737 B2 1/2017 Botte
2006/0049063 A1* 3/2006 Murphy ..... C25B 1/27 205/552

(Continued)

FOREIGN PATENT DOCUMENTS

CN 103866343 A 6/2014
CN 107790628 B 2/2021

(Continued)

OTHER PUBLICATIONS

Hawtof et al ("Catalyst-free, highly selective synthesis of ammonia from nitrogen and water by a plasma electrolytic system", Science Advances, vol. 5, Issue 1, Jan. 2019, pp. 1-9) (Year: 2019).*

(Continued)

*Primary Examiner* — Alexander W Keeling
(74) *Attorney, Agent, or Firm* — Zilka-Kotab, P.C.

(57) ABSTRACT

An advanced manufactured electrochemical reactor to convert air ($N_2$+$O_2$) to nitric acid ($HNO_3$) and ammonia ($NH_3$). The electrochemical reactor platform can be tailored via advanced manufacturing to improve activity, selectivity, energy efficiency and stability of the reactions.

10 Claims, 5 Drawing Sheets

(51) Int. Cl.

| | |
|---|---|
| ***C25B 11/077*** | (2021.01) |
| ***C25B 11/081*** | (2021.01) |
| ***C25B 11/089*** | (2021.01) |

(56) References Cited

U.S. PATENT DOCUMENTS

| | | | | |
|---|---|---|---|---|
| 2016/0083853 | A1* | 3/2016 | Botte | C25B 9/19 205/338 |
| 2016/0251228 | A1* | 9/2016 | Alkusayer | C01C 1/0458 423/360 |
| 2020/0039896 | A1 | 2/2020 | Ding et al. | |
| 2024/0301569 | A1 | 9/2024 | Feaster et al. | |

FOREIGN PATENT DOCUMENTS

| | | | |
|---|---|---|---|
| JP | 2005272856 | A | 10/2005 |
| WO | 2020110155 | A1 | 6/2020 |

OTHER PUBLICATIONS

Erisman et al., "How a Century of Ammonia Synthesis Changed the World," Nature Geoscience, vol. 1, 2008, pp. 636-639.

Qiu et al., "High-performance artificial nitrogen fixation at ambient conditions using a metal-free electrocatalyst," Nature Communications, 2018, pp. 1-8.

Wang et al., "Greening Ammonia toward the Solar Ammonia Refinery," Joule, vol. 2, Jun. 20, 2018, pp. 1055-1074.

Chen et al., "Beyond fossil fuel-driven nitrogen transformations," Science, vol. 360, May 25, 2018, pp. 1-7.

Feaster et al., U.S. Appl. No. 18/667,931, filed May 17, 2024.

International Search Report and Written Opinion from PCT Application No. PCT/US2022/048900, dated Feb. 28, 2023, 11 pages.

Snil, V., "Enriching the Earth," The MIT Press, Feb. 27, 2004, 1 page, Abstract only.

Martín, et al., "Electrocatalytic Reduction of Nitrogen: From Haber-Bosch to Ammonia Artificial Leaf," Chem 2019, 5 (2), 263-283. https://doi.org/10.1016/j.chempr.2018.10.010.

McEnaney, et al., "Ammonia Synthesis from N 2 and H 2 O Using a Lithium Cycling Electrification Strategy at Atmospheric Pressure," Energy Environ. Sci. 2017, 10 (7), 1621-1630. https://doi.org/10.1039/C7EE01126A.

Qing, et al., "Recent Advances and Challenges of Electrocatalytic N 2 Reduction to Ammonia," Chem. Rev. 2020, 120 (12), 5437-5516. https://doi.org/10.1021/acs.chemrev.9b00659.

Wang, et al., "Recent Advances in Electrochemical Synthesis of Ammonia through Nitrogen Reduction under Ambient Conditions," Chem Electro Chem 2020, 7 (5), 1067-1079. https://doi.org/10.1002/celc.201901967.

* cited by examiner

DIRECT CONVERSION OF AIR TO AMMONIA AND NITRIC ACID VIA ADVANCED MANUFACTURED ELECTROCHEMICAL REACTORS

CROSS-REFERENCE TO RELATED APPLICATIONS

This application claims priority to and benefit under 35 U.S.C. § 119(e) of U.S. Provisional Patent Application No. 63/263,520 filed Nov. 4, 2021 entitled "Direct Conversion of Air to Ammonia and Nitric Acid via Advanced Manufactured Electrochemical Reactors," the content of which is hereby incorporated by reference in its entirety for all purposes.

AND STATEMENT AS TO RIGHTS TO APPLICATIONS MADE UNDER AND FEDERALLY SPONSORED RESEARCH DEVELOPMENT

This invention was made with Government support under Contract No. DE-AC52-07NA27344 awarded by the United States Department of Energy. The Government has certain rights in the invention.

BACKGROUND

Field of Endeavor

The present disclosure relates to converting air to ammonia.

State of Technology

This section provides background information related to the present disclosure which is not necessarily prior art.

Over 3.5 billion people—almost half of the world's population—depend on synthetic nitrogen fertilizers to grow food and crops. The industrial production of ammonia ($NH_3$) and nitric acid ($HNO_3$), the two key ingredients for creating nitrogen fertilizers, is made possible via the Haber-Bosch and Otswald processes, respectively. However, these approaches are energy and resource intensive; together, they consume over 2% of the world's total energy and 5% of the world's annual natural gas production. Consequently, these key processes also contribute over 1.5% of the world's total greenhouse gas emissions. Furthermore, both the Otswald and Haber-Bosch processes require high pressures and temperatures to operate; additionally, energy-intensive separation processes must be employed to ensure pure reactant feedstocks and eliminate unwanted side reactions. It is paramount to discover and develop alternative pathways to produce HNO3 and $NH_3$ in an energy-efficient, environmentally sustainable, and industrially scalable manner.

Electrochemical synthesis and catalytic transformations are a promising approach for synthesis of $HNO_3$ and $NH_3$ at room temperature and ambient pressures. There has been increased interest in pursuing electrocatalytic reduction of $N_2$ to $NH_3$ (NRR); while some progress has been achieved, this pathway still requires an energy-costly separation of $N_2$ from air. Furthermore, the competing hydrogen evolution reaction (HER) often results in low selectivity for $NH_3$ in aqueous electrolytes. Alternatively, a direct nitridation of $N_2$ using Li metal has been shown to be an approach to producing $NH_3$ with decent selectivity; however, this pathway requires electrolysis in molten salts, which has a nontrivial separation cost and high energy consumption. Essentially all electrochemical efforts to convert $N_2$ into $NH_3$ have been focused on the cathode; the oxygen evolution reaction (OER) is typically performed on the anode. Almost no research has been conducted on any electrochemical oxidation reactions involving nitrogen.

SUMMARY

Features and advantages of the disclosed apparatus, systems, and methods will become apparent from the following description. Applicant is providing this description, which includes drawings and examples of specific embodiments, to give a broad representation of the apparatus, systems, and methods. Various changes and modifications within the spirit and scope of the application will become apparent to those skilled in the art from this description and by practice of the apparatus, systems, and methods. The scope of the apparatus, systems, and methods is not intended to be limited to the particular forms disclosed and the application covers all modifications, equivalents, and alternatives falling within the spirit and scope of the apparatus, systems, and methods as defined by the claims.

Applicant's apparatus, systems, and methods provide an advanced manufactured electrochemical reactor to convert air ($N_2$+$O_2$) to nitric acid ($HNO_3$) and ammonia ($NH_3$). The electrochemical reactor platform can be tailored via advanced manufacturing to improve activity, selectivity, energy efficiency and stability of the reactions.

Applicant's apparatus, systems, and methods have uses by Agricultural companies, energy and petrochemical companies, farmers, and chemical production companies.

The apparatus, systems, and methods are susceptible to modifications and alternative forms. Specific embodiments are shown by way of example. It is to be understood that the apparatus, systems, and methods are not limited to the particular forms disclosed. The apparatus, systems, and methods cover all modifications, equivalents, and alternatives falling within the spirit and scope of the application as defined by the claims.

BRIEF DESCRIPTION OF THE DRAWINGS

The accompanying drawings, which are incorporated into and constitute a part of the specification, illustrate specific embodiments of the apparatus, systems, and methods and, together with the general description given above, and the detailed description of the specific embodiments, serves to explain the principles of the apparatus, systems, and methods.

DETAILED DESCRIPTION OF SPECIFIC EMBODIMENTS

Figure 1:
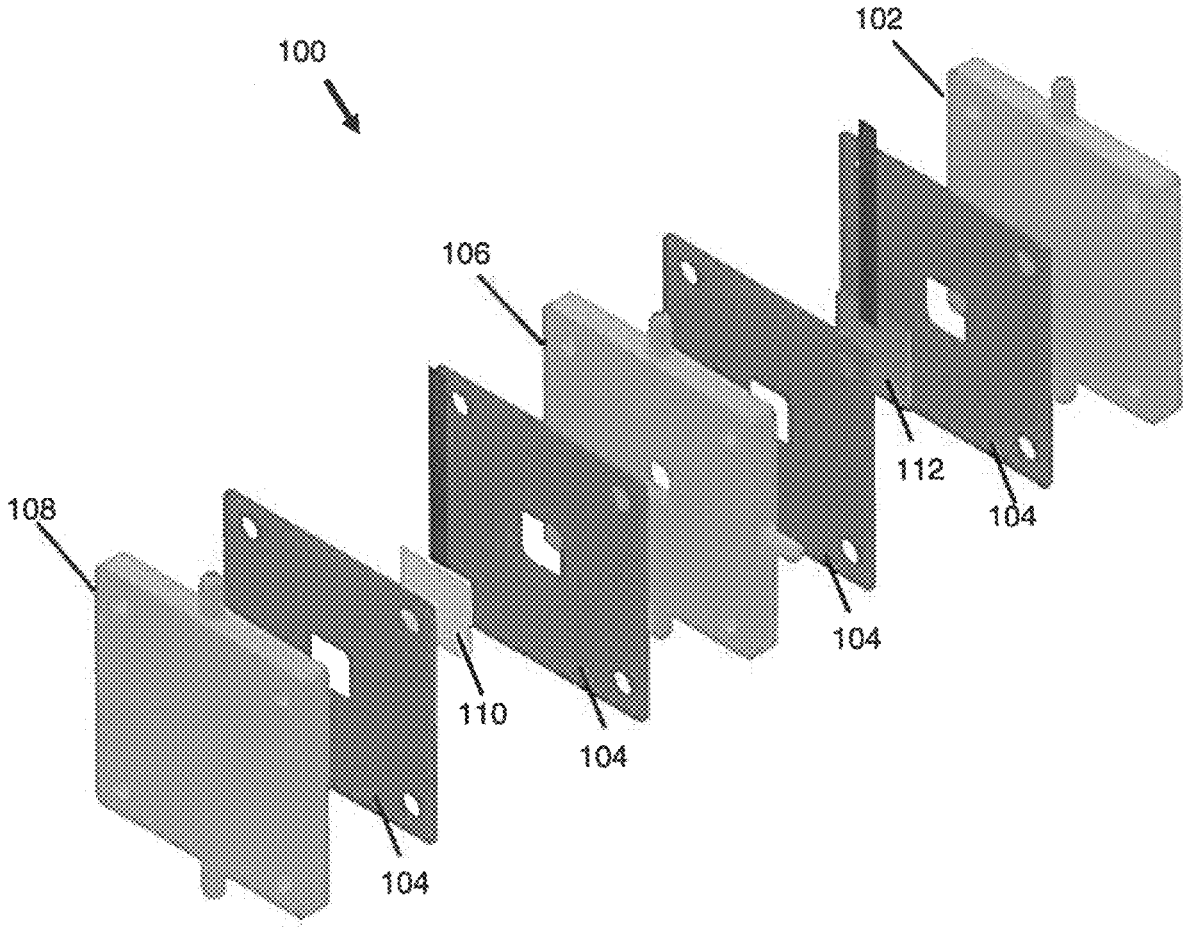
FIG. 1 illustrates one embodiment of the inventor's direct air to ammonia process.

Referring to the drawings, to the following detailed description, and to incorporated materials, detailed information about the apparatus, systems, and methods is provided including the description of specific embodiments. The detailed description serves to explain the principles of the apparatus, systems, and methods. The apparatus, systems, and methods are susceptible to modifications and alternative forms. The application is not limited to the particular forms disclosed. The application covers all modifications, equivalents, and alternatives falling within the spirit and scope of the apparatus, systems, and methods as defined by the claims.

Referring now to the drawings and in particular to FIG. 1, an illustrative view shows an embodiment of Applicant's apparatus, systems, and methods. This embodiment is an advanced manufactured electrochemical reactor that converts air ($N_2$+$O_2$) to nitric acid ($HNO_3$) and ammonia ($NH_3$). This embodiment is identified generally by the reference numeral 100. The components of Applicant's advanced manufactured electrochemical reactor 100 illustrated in FIG. 1 are listed below:

Reference Numeral No. 102—cathode gas compartment,
Reference Numeral No. 104—silicone gaskets
Reference Numeral No. 106—electrolyte liquid compartment,
Reference Numeral No. 108—anode gas compartment,
Reference Numeral No. 110—anode electrocatalyst, and
Reference Numeral No. 112—cathode electrocatalyst.

The description of the structural components of the Applicants' apparatus, systems, and methods 100 having been completed, the operation and additional description of the Applicant's apparatus, systems, and methods 100 will now be considered in greater detail.

FIG. 1 illustrates an advanced manufactured electrochemical reactor 100 that converts air ($N_2$+$O_2$) to nitric acid ($HNO_3$) and ammonia ($NH_3$). The reactor 100 has three main compartments: an anode compartment 102, an electrolyte compartment 106, and a cathode compartment 110. The anode compartment 102 can be left open to air or sealed with a compressed gas (e.g. $N_2$, Ar, $CO_2$) flowing. The electrolyte compartment 106 can be tailored from 15 mm to 1 mm in thickness. The cathode compartment 110 has a flowing gas stream connected.

Figure 2:
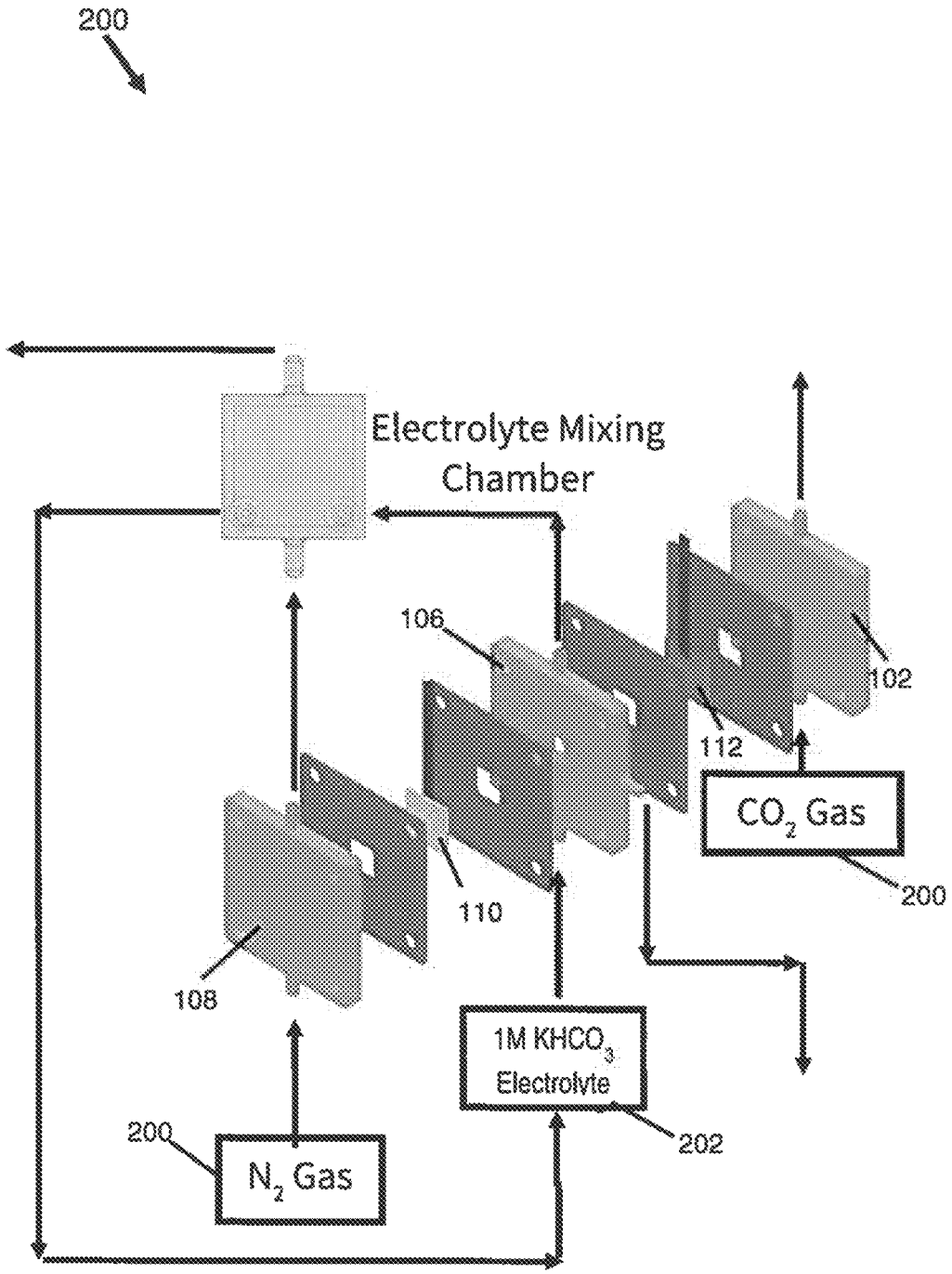
FIG. 2 is an operative view of the embodiment of Applicant's apparatus, systems, and methods shown in FIG. 1.

Referring now to FIG. 2, shows an operative view of the embodiment of Applicant's apparatus, systems, and methods shown in FIG. 1. This view is identified generally by the reference numeral 200. The components of Applicant's advanced manufactured electrochemical reactor 200 are listed below:

Reference Numeral No. 102—cathode gas compartment,
Reference Numeral No. 104—silicone gaskets
Reference Numeral No. 106—electrolyte liquid compartment,
Reference Numeral No. 108—anode gas compartment,
Reference Numeral No. 110—anode electrocatalyst,
Reference Numeral No. 112—cathode electrocatalyst, and
Reference Numeral No. 202—Feed.

The description of the structural components of the operative view of Applicants' electrochemical reactor 200 having been completed, the operation and additional description will now be considered in greater detail.

As shown in FIG. 2, the reactor comprises an anode gas compartment 108, an anode 110, an electrolyte compartment 106, a cathode 112, and a cathode gas compartment 102. The anode may be disposed between the anode gas compartment and the electrolyte compartment. The cathode may be disposed between the cathode gas compartment and the electrolyte compartment.

A feed 200 is fluidly connected to the inlet of the anode gas compartment. The feed may be any suitable feed compatible with the chemical reaction and the reactor. For example, a suitable feed includes, but is not limited to, $N_2$, Air, $CO_2$, Ar, He, $H_2$, $H_2O$, $O_2$, and combinations thereof. The feed may have any suitable flow rate. For example, a suitable flow rate includes, but is not limited to, from about 0 sccm to about 100 sccm, and range or value there between.

The anode geometric current density may be from about 0.5 mA/cm2 to 200 mA/cm2, and any range or value there between. The cathode geometric current density may be from about 0.5 mA/cm2 to 200 mA/cm2, and any range or value there between.

An electrolyte 202 may be fluidly connected to the electrolyte compartment. This electrolyte may be any suitable buffer or liquid compatible with the chemical reaction and the reactor. For example, a suitable electrolyte includes, but is not limited to, any KHCO3 electrolyte, any H2SO4 electrolyte, any K2SO4 electrolyte, any KClO4 electrolyte, and any KOH electrolyte (0.1M to 1M) in water. The electrolyte may have any suitable flow rate. For example, a suitable flow rate includes, but is not limited to, from about 0 mL/min to about 100 mL/min, and range or value there between.

Figure 3A:
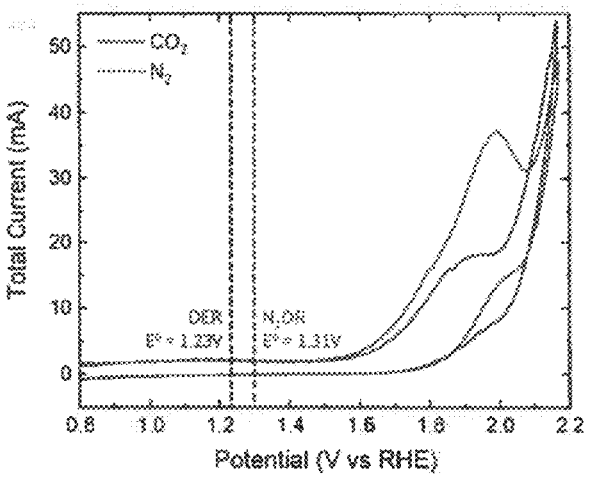
FIGS. 3A and 3B show two graphs showing preliminary experiments with a significant increase in total current.
Figure 3B:
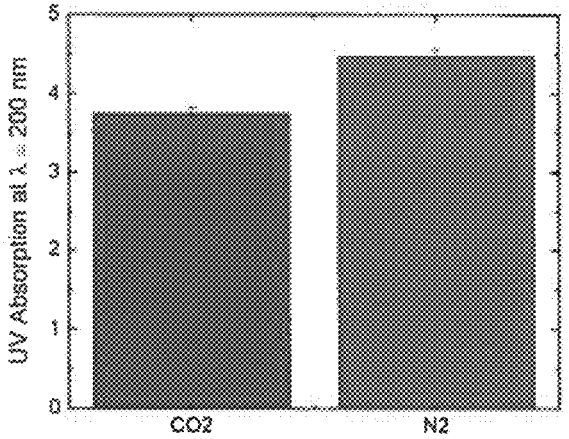

Referring now to FIGS. 3A and 3B, graphs show results of preliminary experiments demonstrating a significant increase in total current. Preliminary experiments showing a significant increase in total current when air is the reactant gas compared to CO2 (A) and a ~20% increase in UV light absorption ($\lambda$=200 nm) in the air sample. Both nitrate and bicarbonate absorb in this region (hence the initial signal in the CO2 control sample); however, the increase in signal in the air sample suggests nitrate was produced.

Figure 4:
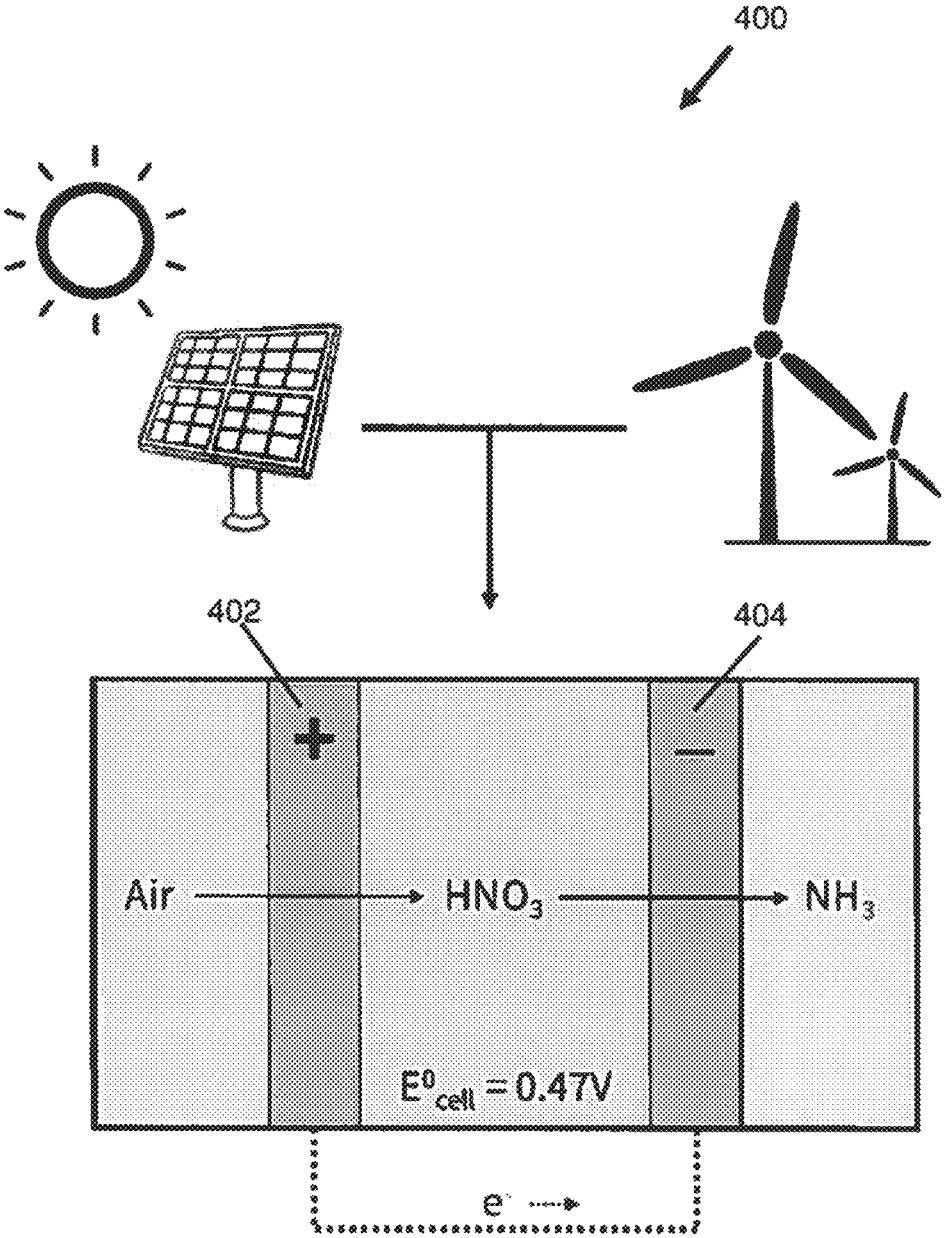
FIG. 4 illustrates direct air to ammonia process using renewable energy.

Referring now to FIG. 4 direct air to ammonia process using renewable energy 400 is illustrated by a schematic. As illustrated in FIG. 4 renewable energy is used to power an advanced manufactured electrochemical reactor that converts air ($N_2$+$O_2$) to nitric acid ($HNO_3$) and ammonia ($NH_3$). Renewable energy is energy that has been derived from earth's natural resources that are not finite or exhaustible, such as wind and sunlight. Solar energy is derived by capturing radiant energy from sunlight and converting it into heat, electricity, or hot water. Photovoltaic (PV) systems can convert direct sunlight into electricity through the use of solar cells. Wind farms capture the energy of wind flow by using turbines and converting it into electricity. There are several forms of systems used to convert wind energy and each vary. Commercial grade wind-powered generating systems can power many different organizations, while single-wind turbines are used to help supplement pre-existing energy organizations. Another form is utility-scale wind farms, which are purchased by contract or wholesale. Technically, wind energy is a form of solar energy. The ocean can produce two types of energy: thermal and mechanical. Ocean thermal energy relies on warm water surface temperatures to generate energy through a variety of different systems. Using the reactor in FIG. 4 Nitrogen is oxidized to nitrate on the anode 402, then reduced to ammonia on the cathode 404. Other reactions can be performed at the cathode.

Figure 5:
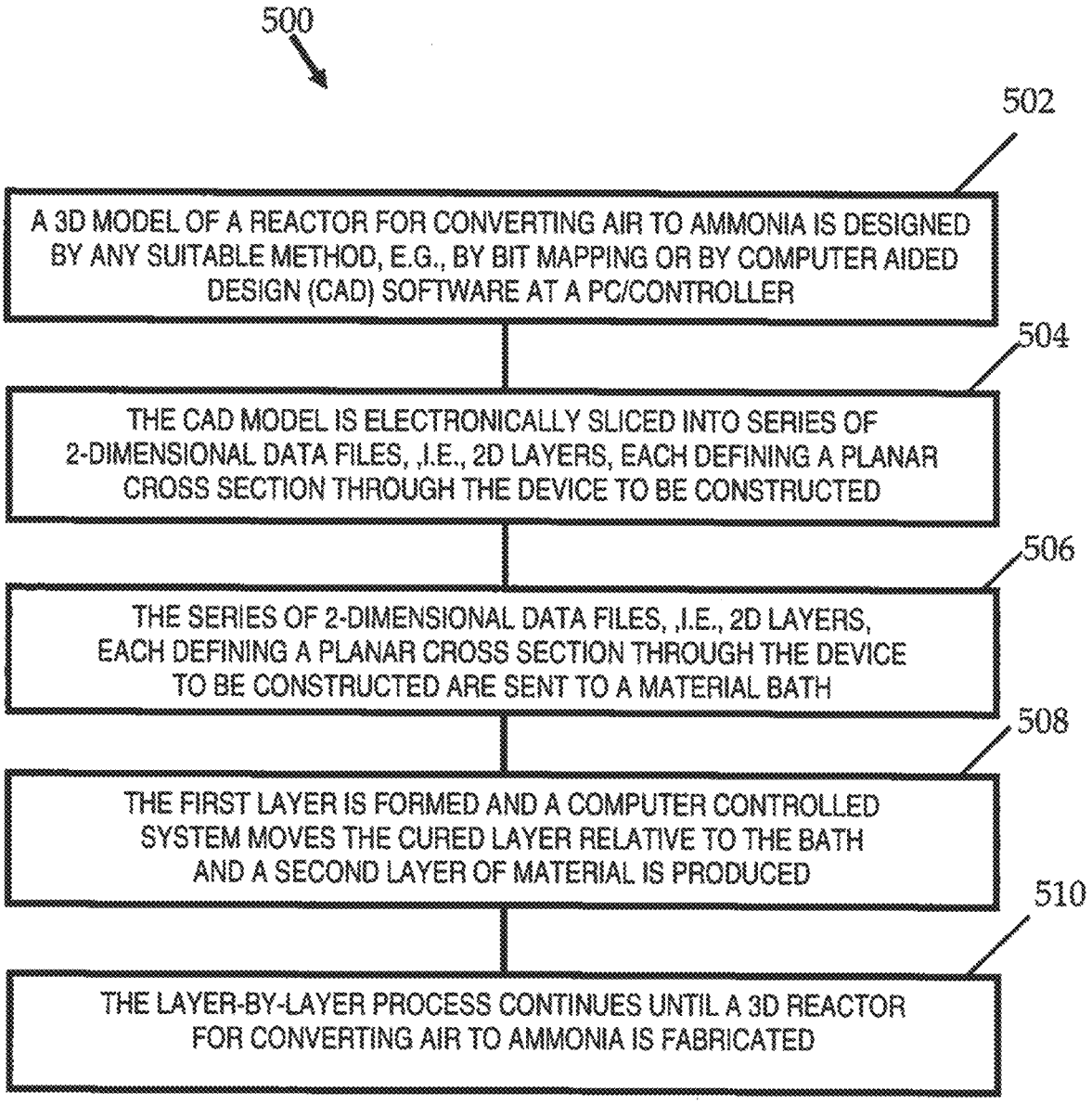
FIG. 5 an additive manufacturing system of producing a reactor for converting air to ammonia is illustrated by a flow chart.

Applicant's apparatus, systems, and methods include producing an electrochemical reactor that converts air ($N_2$+$O_2$) to nitric acid ($HNO_3$) and ammonia ($NH_3$) by advanced manufacturing. Referring now to FIG. 5 one embodiment of an additive manufacturing system of producing a reactor for converting air to ammonia is illustrated by a flow chart. The additive manufacturing system of producing a reactor for converting air to ammonia is designated generally by the reference numeral 500.

The flow chart illustrates the steps described below.

Step 502—a 3D model of a reactor for converting air to ammonia is designed by any suitable method, e.g., by bit mapping or by computer aided design (CAD) software at a PC/controller.

Step 504—the CAD model is electronically sliced into series of 2-dimensional data files, i.e., 2D layers, each defining a planar cross section through the device to be constructed.

Step 506—the series of 2-dimensional data files, i.e., 2D layers, each defining a planar cross section through the device to be constructed are sent to a material bath Step 508—the first layer is formed and a computer controlled system moves the cured layer relative to the bath and a second layer of material is produced.

Step 510—The layer-by-layer process continues until a 3D reactor for converting air to ammonia is fabricated.

The steps of Applicant's additive manufacturing system of producing a reactor for converting air to ammonia having been completed, the operation and additional description will now be considered. There are a wide variety of additive manufacturing processes that can be used to create massively complicated assemblies. Examples include powder-bed laser printing systems, fused deposition modeling, and other process that involve producing complex assemblies.

Applicant's additive manufacturing system of producing a reactor for converting air to ammonia begins with the creation of a 3D model of a reactor for converting air to ammonia. For example it can be designed by any suitable method, e.g., by bit mapping or by computer aided design (CAD) software at a PC/controller. The CAD model is electronically sliced into series of 2-dimensional data files, i.e., 2D layers, each defining a planar cross section through the device to be constructed. The series of 2-dimensional data files, i.e., 2D layers, each defining a planar cross section through the device to be constructed are sent to a material bath. The first layer is formed and a computer controlled system moves the cured layer relative to the bath and a second layer of material is produced. The layer-by-layer process continues until a 3D reactor for converting air to ammonia is fabricated. The reactor converts air ($N_2$+$O_2$) to nitric acid ($HNO_3$) and ammonia ($NH_3$).

Therefore, it will be appreciated that the scope of the present application fully encompasses other embodiments which may become obvious to those skilled in the art. In the claims, reference to an element in the singular is not intended to mean "one and only one" unless explicitly so stated, but rather "one or more." All structural and functional equivalents to the elements of the above-described preferred embodiment that are known to those of ordinary skill in the art are expressly incorporated herein by reference and are intended to be encompassed by the present claims. Moreover, it is not necessary for a device to address each and every problem sought to be solved by the present apparatus, systems, and methods, for it to be encompassed by the present claims. Furthermore, no element or component in the present disclosure is intended to be dedicated to the public regardless of whether the element or component is explicitly recited in the claims. No claim element herein is to be construed under the provisions of 35 U.S.C. 112, sixth paragraph, unless the element is expressly recited using the phrase "means for."

While the apparatus, systems, and methods may be susceptible to various modifications and alternative forms, specific embodiments have been shown by way of example in the drawings and have been described in detail herein. However, it should be understood that the application is not intended to be limited to the particular forms disclosed. Rather, the application is to cover all modifications, equivalents, and alternatives falling within the spirit and scope of the application as defined by the following appended claims.

The invention claimed is:

1. An apparatus for converting air to ammonia, comprising:

an anode gas compartment, wherein said anode gas compartment is open to the air, an anode electrocatalyst operably configured to convert nitrogen from air to nitrate at the anode electrocatalyst by a nitrogen oxidation reaction, an electrolyte liquid compartment, a cathode compartment, and a cathode electrocatalyst operably configured to convert the nitrate to ammonia at the cathode electrocatalyst by a nitrate reduction reaction.

2. The apparatus for converting air to ammonia of claim 1 wherein said anode electrocatalyst is a platinum (Pt), titanium (Ti), iridium (Ir), nickel (Ni), iron (Fe), ruthenium (Ru), palladium (Pd), tin (Sn), or gallium (Ga) electrocatalyst.

3. The apparatus for converting air to ammonia of claim 2 wherein said anode electrocatalyst includes oxides, alloys, and/or mixtures of platinum (Pt), titanium (Ti), Iridium (Ir), Nickle (Ni), Iron (Fe), Ruthenium (Ru), Palladium (Pd), tin (Sn), or Gallium (Ga).

4. The apparatus for converting air to ammonia of claim 1 wherein said cathode electrocatalyst is a silver (Ag), gold (Au), copper (Cu), platinum (Pt), titanium (Ti), iridium (Ir), nickel (Ni), Iron (Fe), or tin (Sn) electrocatalyst.

5. The apparatus for converting air to ammonia of claim 4 wherein said cathode electrocatalyst includes oxides, alloys, and/or mixtures of silver (Ag), gold ((Au), copper (Cu), platinum (Pt), titanium (Ti), iridium (Ir), nickel (Ni), Iron (Fe), or tin (Sn).

6. The apparatus for converting air to ammonia of claim 1 further comprising silicone gaskets located between said anode gas compartment, said anode electrocatalyst, said electrolyte liquid compartment, said cathode compartment, and said cathode electrocatalyst.

7. The apparatus for converting air to ammonia of claim 1 wherein a flowing gas stream is connected to said cathode compartment.

8. The apparatus for converting air to ammonia of claim 1 wherein the air comprises $N_2$ and $O_2$.

9. The apparatus for converting air to ammonia of claim 1 wherein the apparatus converts nitrogen and oxygen to nitric acid and ammonia.

10. The apparatus for converting air to ammonia of claim 1 wherein said apparatus converts nitrogen and oxygen to nitric acid and ammonia and further comprising a system for converting said ammonia and nitric acid to fertilizers.

* * * * *